US008397317B2

(12) United States Patent
Funari et al.

(10) Patent No.: US 8,397,317 B2
(45) Date of Patent: Mar. 19, 2013

(54) FLUSH ACTUATOR ASSEMBLY AND METHOD THEREFOR

(75) Inventors: Michael A. Funari, Apex, NC (US); Robert E. Saadi, Erie, PA (US); Jeffrey T. Phillips, Sanford, NC (US); Joseph J. Ballachino, Pittsboro, NC (US)

(73) Assignee: Zurn Industries, LLC, Erie, PA (US)

( * ) Notice: Subject to any disclaimer, the term of this patent is extended or adjusted under 35 U.S.C. 154(b) by 1074 days.

(21) Appl. No.: 12/133,601

(22) Filed: Jun. 5, 2008

(65) Prior Publication Data

US 2009/0007319 A1 Jan. 8, 2009

Related U.S. Application Data

(60) Provisional application No. 60/933,527, filed on Jun. 7, 2007.

(51) Int. Cl.

| | |
|---|---|
| ***E03D 11/00*** | (2006.01) |
| ***E03D 11/03*** | (2006.01) |
| ***F16K 31/44*** | (2006.01) |
| ***F16K 31/12*** | (2006.01) |

(52) U.S. Cl. ..... 4/249; 251/40; 251/44; 251/244; 251/229; 251/339

(58) Field of Classification Search ..... 251/33, 251/38, 40, 44, 339, 229, 244, 234; 4/429
See application file for complete search history.

(56) References Cited

U.S. PATENT DOCUMENTS

| | | | | |
|---|---|---|---|---|
| 605,621 | A | 6/1898 | Acklin | |
| 1,114,398 | A | 10/1914 | Sloan | |
| 1,519,654 | A | 12/1924 | Banta | |
| 1,868,520 | A | 7/1932 | Brooks | |
| 1,868,591 | A | 7/1932 | Tanner | |
| 1,896,950 | A | 2/1933 | Groeniger | |
| 1,912,937 | A | 6/1933 | George | |
| 2,038,135 | A | 4/1936 | Sloan | |
| 2,136,221 | A | 11/1938 | Sloan | |
| 2,164,760 | A | 7/1939 | Wesson | |
| 2,210,860 | A | 8/1940 | Regnell | |
| 2,369,104 | A | 2/1945 | Fredrickson | |
| 2,472,576 | A | 6/1949 | Dobrick | |
| 2,612,187 | A * | 9/1952 | Romanelli et al. | 251/40 |
| 2,620,826 | A | 12/1952 | Johns | |
| 2,633,141 | A | 3/1953 | Russell | |
| 2,734,712 | A | 2/1956 | Fraser | |
| 2,738,946 | A * | 3/1956 | Filliung | 251/35 |

(Continued)

OTHER PUBLICATIONS

ASME A112.19.2-2003, "Vitreous China Plumbing Fixtures and Hydraulic Requirements for Water Closets and Urinals", The American Society of Mechanical Engineers, 2004, pp. i-viii and pp. 1-59.

(Continued)

*Primary Examiner* — Jeanette Chapman
(74) *Attorney, Agent, or Firm* — The Webb Law Firm

(57) ABSTRACT

A flush actuator assembly for use with a flush valve having a relief post is disclosed. The flush actuator assembly includes a valve actuator having a first end, a second end, and an aperture extending therebetween. The aperture is adapted to surround at least a portion of the relief valve post. Movement of the valve actuator in a first direction engages the relief valve post at a first location on the post and displaces the relief valve post by a first separation distance. Movement of the valve actuator in a second direction engages the relief valve post at a second location on the post and displaces the relief valve post by a second separation distance. The first separation distance and the second separation distance are different.

35 Claims, 13 Drawing Sheets

U.S. PATENT DOCUMENTS

| | | | | | |
|---|---|---|---|---|---|
| 3,085,779 | A | | 4/1963 | Phililppe | |
| 3,399,860 | A | | 9/1968 | Billeter et al. | |
| 3,406,940 | A | * | 10/1968 | Kertell | 251/40 |
| 3,594,828 | A | | 7/1971 | Seek | |
| 3,695,254 | A | | 10/1972 | Blum | |
| 3,778,023 | A | | 12/1973 | Billeter | |
| 3,806,962 | A | | 4/1974 | Sievers | |
| 3,935,598 | A | | 2/1976 | Schmidt | |
| 4,022,380 | A | | 5/1977 | Scragg | |
| 4,096,591 | A | | 6/1978 | Awis | |
| 4,134,570 | A | * | 1/1979 | Walker | 251/40 |
| 4,141,092 | A | * | 2/1979 | Jones | 4/324 |
| 4,202,525 | A | | 5/1980 | Govaer et al. | |
| 4,225,987 | A | | 10/1980 | Goldman et al. | |
| 4,433,445 | A | | 2/1984 | Morris et al. | |
| 4,498,203 | A | * | 2/1985 | Barnum et al. | 4/427 |
| 4,576,272 | A | | 3/1986 | Morgan, Jr. et al. | |
| 4,802,246 | A | * | 2/1989 | Laverty, Jr. | 4/427 |
| 4,817,913 | A | | 4/1989 | Whiteside | |
| 4,883,254 | A | | 11/1989 | Whiteside | |
| 4,891,864 | A | * | 1/1990 | Laverty, Jr. | 91/399 |
| 4,991,576 | A | * | 2/1991 | Henkin et al. | 128/203.28 |
| 5,026,021 | A | | 6/1991 | Pino | |
| 5,129,110 | A | | 7/1992 | Richter | |
| 5,205,000 | A | | 4/1993 | Xia et al. | |
| 5,398,675 | A | * | 3/1995 | Henkin et al. | 128/203.12 |
| 5,415,374 | A | | 5/1995 | Carroll et al. | |
| 5,476,244 | A | | 12/1995 | Carroll et al. | |
| 5,524,297 | A | | 6/1996 | Harrison | |
| 5,742,951 | A | * | 4/1998 | Wright et al. | 4/381 |
| 5,881,993 | A | | 3/1999 | Wilson et al. | |
| 6,019,343 | A | | 2/2000 | Tsai | |
| 6,299,127 | B1 | | 10/2001 | Wilson | |
| 6,381,764 | B2 | | 5/2002 | Stahlhut | |
| 6,408,873 | B1 | | 6/2002 | Hall et al. | |
| 6,442,772 | B2 | | 9/2002 | Han et al. | |
| 6,453,481 | B1 | * | 9/2002 | Pondelick et al. | 4/431 |
| 6,499,716 | B2 | | 12/2002 | Nortier | |
| 6,510,563 | B1 | | 1/2003 | Jarosinski et al. | |
| 6,604,249 | B2 | | 8/2003 | Han et al. | |
| 6,742,194 | B2 | | 6/2004 | Shim | |
| 6,785,913 | B2 | | 9/2004 | Ho | |
| 6,905,108 | B2 | | 6/2005 | Hall et al. | |
| 6,966,536 | B2 | | 11/2005 | Enomoto et al. | |
| 7,010,816 | B2 | * | 3/2006 | Li | 4/354 |
| 7,481,413 | B2 | * | 1/2009 | Funari | 251/40 |
| 8,042,787 | B2 | * | 10/2011 | Wilson | 251/40 |
| 2004/0026640 | A1 | | 2/2004 | Enomoto et al. | |
| 2004/0040079 | A1 | | 3/2004 | Snyder | |
| 2004/0194200 | A1 | * | 10/2004 | Li | 4/354 |
| 2005/0133754 | A1 | * | 6/2005 | Parsons et al. | 251/129.17 |
| 2006/0151729 | A1 | | 7/2006 | Wilson | |
| 2006/0202141 | A1 | | 9/2006 | Perlstein | |
| 2007/0210271 | A1 | * | 9/2007 | Wilson | 251/40 |

OTHER PUBLICATIONS

ASME A112.19.14-2006, "Six-Liter Water Closets Equipped With a Dual Flushing Device", The American Society of Mechanical Engineers, 2006, pp. ii-vi and pp. 1-2.

E-mail communication dated Mar. 6, 2009, Zurn Industries (3 pgs.).

Zurn Industries, Inc.; Redacted drawing entitled "Handle Seal Retainer", drawing dated Sep. 12, 2000.

American Society of Mechanical Engineers, A112.19.14-2001, published Aug. 1, 2002.

* cited by examiner

FLUSH ACTUATOR ASSEMBLY AND METHOD THEREFOR

CROSS-REFERENCE TO RELATED APPLICATION

This application claims the benefit of U.S. Provisional Application Ser. No. 60/933,527 filed Jun. 7, 2007, the entire contents of which is hereby incorporated by reference.

BACKGROUND OF THE INVENTION

1. Field of the Invention

The present invention relates in general to a flush valve for water closets and other plumbing equipment and, more particularly, to a flush actuator assembly utilized on a flush valve.

2. Description of Related Art

Flush valves in water closets and other plumbing devices which utilize a flexible diaphragm to establish and to seal off the connection between the inlet and outlet are well known in the art. FIG. 1 illustrates a typical prior art flush valve 5. The flush valve 5 has a valve body 10, generally made of brass, which includes an inlet 12 and outlet 14 and an actuator connection 16. A barrel section 18 is positioned within the flush valve 5 such that the connection between the inlet 12 and the outlet 14 is through the barrel section 18. A valve seat 20 is formed on a top or sealing end 21 of the barrel section 18. The valve seat 20 is normally closed by a diaphragm 22 extending across the valve body 10 and defining an upper chamber 24. The diaphragm 22 has a by-pass 26 which provides fluid communication between the inlet 12 of the flush valve 5 and the upper chamber 24. The diaphragm 22 is attached at its outer edge to the valve body 10 and is clamped in place by an annular clamping rim 27 on an upper cover 11 of the valve body 10. The diaphragm 22 has a central opening 23 which allows for fluid communication between the upper chamber 24 and the outlet 14. A relief valve 28 normally closes the central opening 23 of the diaphragm 22.

The operation of the flush valve 5 is generally as follows. In the normally closed position shown in FIG. 1, water pressure in the valve inlet 12 is communicated to the upper chamber 24 through the by-pass 26 defined in the diaphragm 22. Because the surface area which is subjected to water pressure is greater on the upper side of the diaphragm 22, the water pressure forces the diaphragm down onto the sealing end 21 of the barrel section 18 (i.e., valve seat 20), thus preventing water from flowing to the outlet 14. A flush actuator assembly 30 is attached to the valve body through the actuator connection 16 and moves a plunger rod 32 inwardly which contacts and displaces a relief valve post 40 of the relief valve 28 which then displaces from the valve seat 20 a valve seat seal 42 connected to the relief valve post 40.

This releases the pressure in the upper chamber 24 by allowing water to flow through the central opening 23 of the diaphragm 22 to the outlet 14. After the diaphragm 22 and the relief valve 28 move upwardly, the relief valve 28 resets itself thereby causing the valve seat seal 42 to cover the valve seat 20, thereby closing off the upper chamber 24 except for the passageway provided by the by-pass 26. Water then flows through the by-pass 26 into the upper chamber 24 until the diaphragm 22 is again forced against the valve seat 20, thereby closing the valve. The flush actuator assembly 30 includes a drive mechanism such as a handle 44 or another device capable of displacing the plunger rod 32 against the relief valve post 40, including a motor or solenoid well known to those skilled in the art of flush valve designs.

With a focus on water conservation, valve designers are now exploring modifications to flush valves to more closely adjust and control the quantity of water passing through the flush valve for each flush. Accordingly, an object of the subject invention is to provide a mechanism capable of adjusting and controlling the quantity of water through a flush valve for each individual flush.

SUMMARY OF THE INVENTION

In one embodiment of the present invention, a flush actuator assembly for use with a flush valve having a relief post includes a valve actuator. The valve actuator has a first end, a second end, and an aperture extending therebetween. The aperture is adapted to surround at least a portion of the relief valve post. Movement of the valve actuator in a first direction engages the relief valve post at a first location on the post and displaces the relief valve post by a first separation distance. Movement of the valve actuator in a second direction engages the relief valve post at a second location on the post and displaces the relief valve post by a second separation distance. The first separation distance and the second separation distance are different.

The flush actuator assembly may further include a plunger rod connected to the valve actuator such that movement of the plunger rod moves the valve actuator in at least one of the first direction and second direction. The flush actuator assembly may further include a housing having a bore extending therethrough, with the plunger rod extends at least partially through the bore. Alternatively, the flush actuator assembly may include an initiating mechanism for transitioning the valve actuator in at least one of a first direction and a second direction. The initiating mechanism may be a push button or a sensor.

The first end of the valve actuator may include a high rim and a low rim. In one configuration, movement of the valve actuator in the first direction contacts the relief valve post with the high rim, and movement of the valve actuator in the second direction contacts the relief valve post with the low rim. The high rim may extend in an opposite direction from the second end by a first length, and the low rim may extend in an opposite direction from the second end by a second length, with the first length being greater than the second length.

In a particular configuration, the first direction and the second direction are substantially opposite from each other. In an alternative configuration, the first direction and the second direction are at substantially right angles with respect to each other. In operation, movement of the valve actuator in the first direction initiates a full flush cycle, and movement of the valve actuator in the second direction initiates a reduced flush cycle.

In another embodiment of the present invention, a flush valve includes a housing having an inlet and an outlet. The flush valve also includes a valve seat disposed between the inlet and the outlet, and a valve seat seal engageable with the valve seat to form a substantially liquid impermeable seal therewith. The flush valve also includes a relief valve post engaged with the valve seat seal. The flush valve further includes a valve actuator having a first end, a second end, and an aperture extending therebetween. The aperture may be adapted to surround at least a portion of the relief valve. Movement of the valve actuator in a first direction engages the relief valve post at a first location on the post, and displaces the relief valve post by a first separation distance which disengages the valve seat seal from the valve seat. Movement of the valve actuator in a second direction engages the relief valve post at a second location on the post, and displaces the relief valve post by a second separation distance which disengages the valve seat seal from the valve seat. The first separation distance and the second separation distance are different.

The flush valve may further include a plunger rod connected to the valve actuator such that movement of the plunger rod moves the valve actuator in at least one of the first direction and second direction. Alternatively, the flush valve may include an initiating mechanism for transitioning the valve actuator in at least one of a first direction and a second direction. The initiating mechanism may be a push button or a sensor.

The first end of the valve actuator may include a high rim and a low rim. In one configuration, movement of the valve actuator in the first direction contacts the relief valve post with the high rim, and movement of the valve actuator in the second direction contacts the relief valve post with the low rim. Movement of the valve actuator in the first direction may initiate a full flush cycle, and movement of the valve actuator in the second direction may initiate a reduced flush cycle.

In yet another embodiment of the present invention, a method of actuating a flush valve to select a flush cycle includes the step of providing a flush valve. The flush valve may include a housing having an inlet and an outlet, and a valve seat disposed between the inlet and the outlet. The flush valve also includes a valve seat seal engageable with the valve seat to form a substantially liquid impermeable seal therewith, and a relief valve post engaged with the valve seat seal. The flush valve also includes a valve actuator having a first end, a second end, and an aperture extending therebetween. The aperture may be adapted to surround at least a portion of the relief valve post. Movement of the valve actuator in a first direction engages the relief valve post at a first location on the post, and displaces the relief valve post by a first separation distance which disengages the valve seat seal from the valve seat. Movement of the valve actuator in a second direction engages the relief valve post at a second location on the post, and displaces the relief valve post by a second separation distance which disengages the valve seat seal from the valve seat. The first separation distance and the second separation distance are different. The method further includes the step of moving the valve actuator in either a first direction to initiate a full flush cycle, or a second direction to initiate a reduced flush cycle.

The step of moving the valve actuator may further include initiating at least one of a plunger rod, push button and a sensor to move the valve actuator in either the first direction or the second direction.

In another embodiment of the present invention, a flush actuator assembly for use with a flush valve having a relief valve post includes a plurality of valve actuators positioned about the relief valve post. Movement of one of the valve actuators in an axial direction contacts the relief valve post at a first location on the post and displaces the relief valve post by a first separation distance. Movement of another of the valve actuators in an axial direction contacts the relief valve post at a second location on the post and displaces the relief valve post by a second separation distance. The first separation distance and the second separation distance are different.

In one configuration, the assembly includes two valve actuators. The valve actuators may be offset by about 90°. Each of the valve actuators may include a rod adapted to contact the relief valve post. Each of the valve actuators may contact the relief valve post by activation of an initiating mechanism. In another configuration, a first valve actuator may have a contact diameter that is greater than a contact diameter of a second valve actuator. Optionally, the initiating mechanism may be a push button. In another configuration, each of the valve actuators are coupled to each other, such as hydraulically coupled to each other.

In another embodiment of the present invention, a flush valve includes a housing having an inlet and an outlet, a valve seat disposed between the inlet and the outlet, and a valve seat seal engageable with the valve seat to form a substantially liquid impermeable seal therewith. The flush valve also includes a relief valve post engaged with the valve seat seal, and a plurality of valve actuators positioned about the relief valve. Movement of one of the valve actuators in an axial direction contacts the relief valve post at a first location on the post and displaces the relief valve post by a first separation distance. Movement of another of the valve actuators in an axial direction contacts the relief valve post at a second location on the post and displaces the relief valve post by a second separation distance. The first separation distance and the second separation distance are different.

Optionally, the housing includes a plurality of actuator passageways to receive a respective valve actuator therein. In another configuration, the valve includes two valve actuators offset to each other by 90°, and the housing includes two actuator passageways to receive the respective valve actuators therein.

In another embodiment of the present invention, a method of actuating a flush valve to select a flush cycle includes the step of providing a flush valve. The flush valve includes a housing having an inlet and an outlet, a valve seat disposed between the inlet and the outlet, and a valve seat seal engageable with the valve seat to form a substantially liquid impermeable seal therewith. The flush valve also includes a relief valve post engaged with the valve seat seal, and a plurality of valve actuators positioned about the relief valve post. Movement of one of the valve actuators in an axial direction contacts the relief valve post at a first location on the post and displaces the relief valve post by a first separation distance. Movement of another of the valve actuators in an axial direction contacts the relief valve post at a second location on the post and displaces the relief valve post by a second separation distance. The first separation distance and the second separation distance are different. The method also includes the step of moving one valve actuator in an axial direction to initiate the full flush cycle, or moving another valve actuator in an axial direction to initiate a reduced flush cycle.

DETAILED DESCRIPTION OF THE INVENTION

Figure 1:
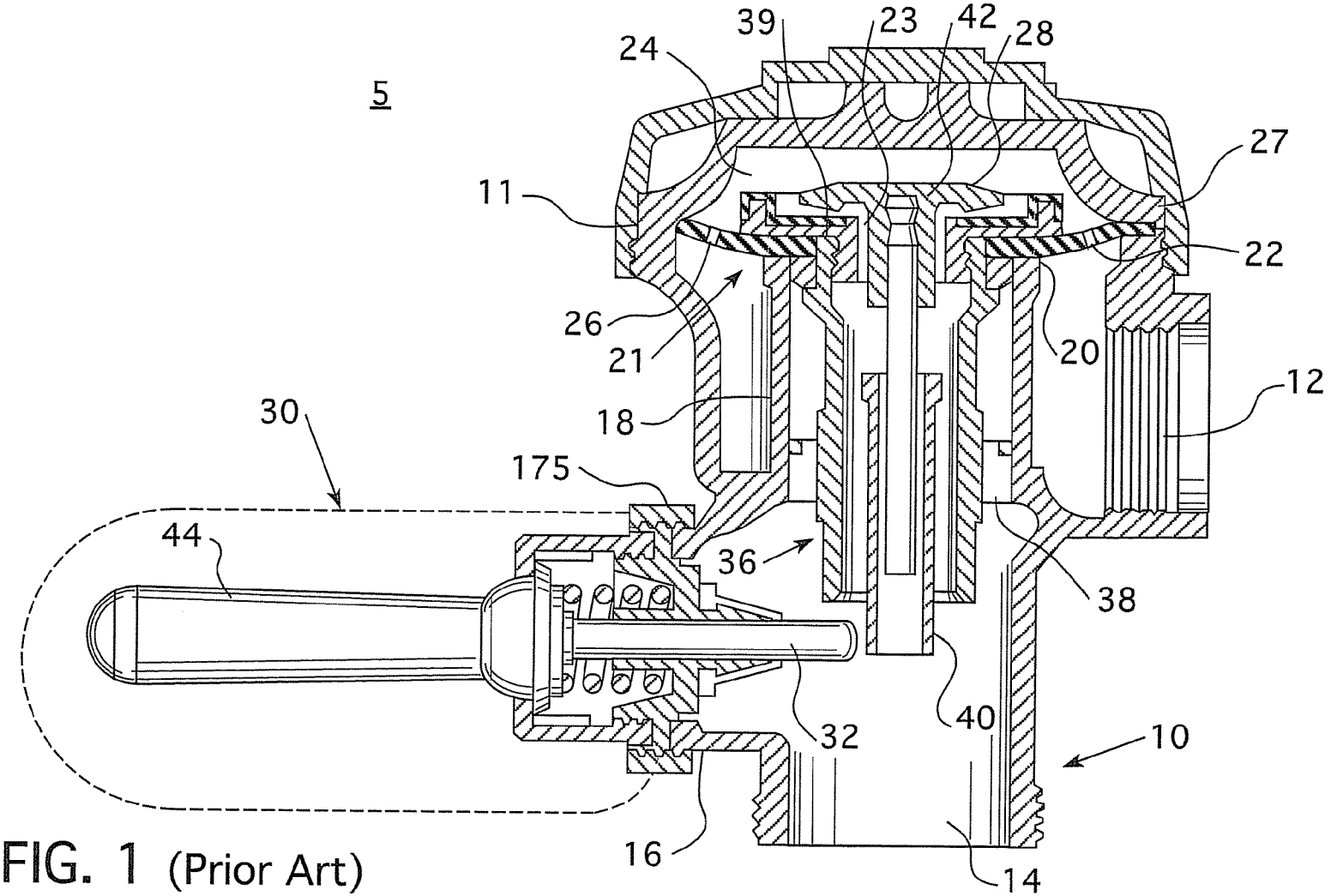
FIG. 1 (Prior Art)
FIG. 1 is a partial sectional view of a prior flush valve with a flush actuator assembly.
Figure 3A:
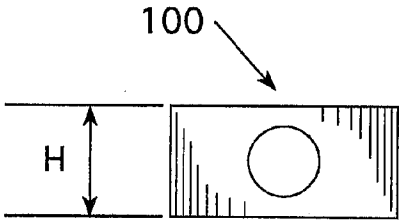
FIG. 3A is a front view of the flush actuator of FIG. 2.

It has long been known that the flush duration of a flush valve is directly affected by the length of time in which the relief valve within the flush valve is open. Some prior art flush valve designs have included an adjustable screw in the cap of the flush valve body which protrudes through the body and limits the distance the relief valve seal of the relief valve may separate from the valve seat. However, directing attention to the prior flush valve as shown in FIG. 1, it has been discovered that the position the plunger rod 32 contacts the relief valve post 40 along the length of the post 40 determines how far the valve seat seal 42 separates from the valve seat 20.

Figure 2:
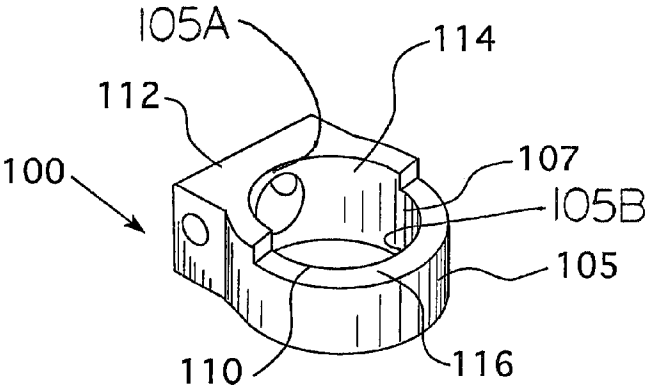
FIG. 2 is a perspective view of a flush actuator in accordance with an embodiment of the present invention.
Figure 3D:
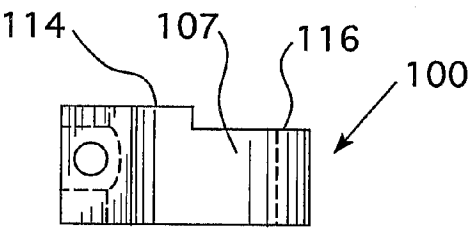
FIG. 3D is a right side view of the flush actuator of FIG. 2.
Figure 3C:
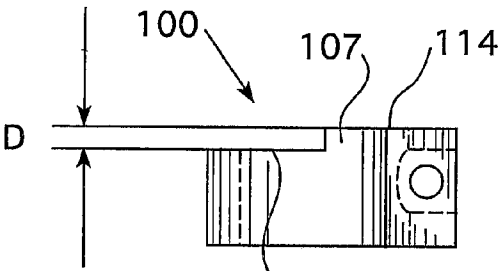
FIG. 3C is a left side view of the flush actuator of FIG. 2.
Figure 3B:
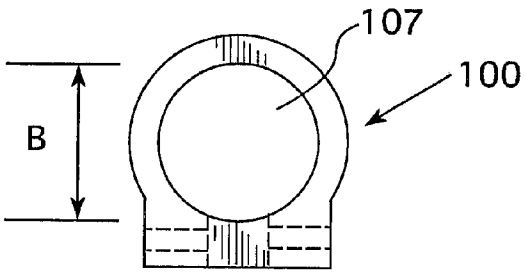
FIG. 3B is a top view of the flush actuator of FIG. 2.

As shown in FIGS. 2-3D, the valve actuator 100 of the present invention includes an actuator body 105 having an aperture 107 extending therethrough. The edge 110 of the aperture 107 is stepped such that there is defined on the top surface 112 a high rim 114 at a first end 105A and an opposing low rim 116 at a second end 105B. In one embodiment, as shown in FIG. 3C, the distance D between the high rim 114 and the low rim 116 is sufficient to effectuate a difference in flush volume. In one embodiment, the distance D is from about 0.05 inches to about 0.10 inches. The valve actuator 100 may have any suitable overall height H, and the distance D between the high rim 114 and the low rim 116 may be from about 25% to about 75% the overall height H of the valve actuator 100. In one embodiment, the overall height H may be from about 0.250 inches to about 0.325 inches. In another embodiment, the distance D may be from about 20% to about 30% the overall height H of the valve actuator 100. As shown in FIG. 3B, in a further embodiment, the aperture 107 may be substantially circular and may have any suitable diameter B. In one embodiment, the diameter B may be from about 0.50 inches to about 0.75 inches. In another embodiment, the diameter of the aperture 107 is larger than the diameter of the valve relief post 40.

Figure 5:
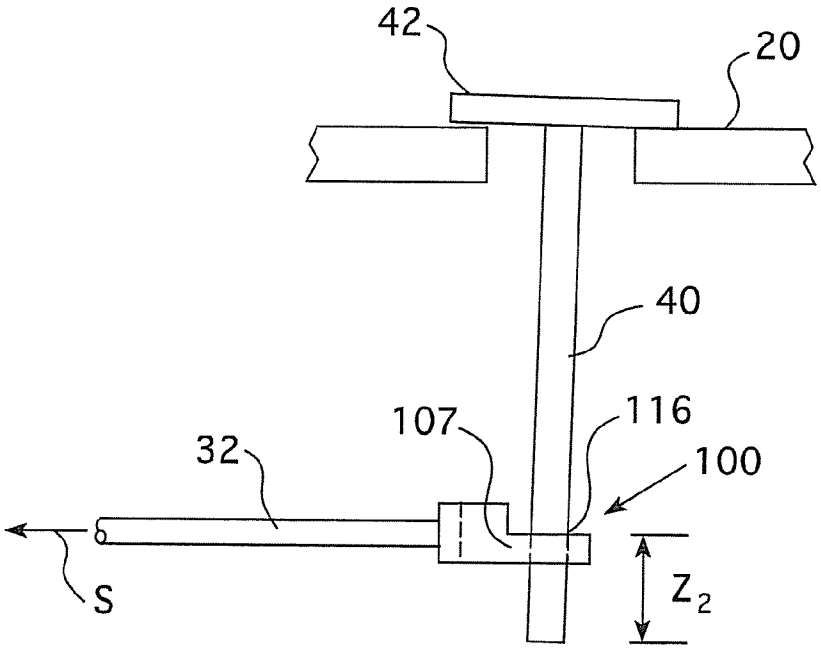
FIG. 5 is a schematic representation of the displacement of the relief valve with the plunger rod oriented in a second position.
Figure 4:
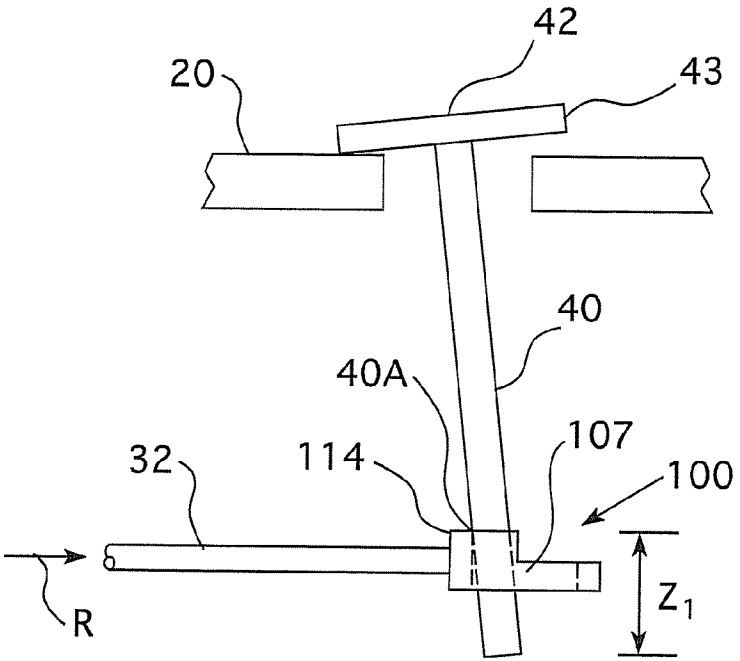
FIG. 4 is a schematic representation of the displacement of the relief valve with the plunger rod oriented in a first position.

Referring to FIGS. 4 and 5, it has been discovered that by utilizing a valve actuator 100, as shown in FIGS. 2-3D, the relief valve post 40 may be laterally displaced by different distances depending on whether the valve actuator 100 is moved in a first direction relative to the relief valve post 40, shown in FIG. 4, or in a second direction relative to the relief valve post 40, shown in FIG. 5. The lateral displacement of the relief valve post 40 causes the valve seat seal 42 to separate from the valve seat 20 by different amounts, corresponding to whether the valve actuator 100 is moved in the first direction or the second direction. The amount of separation between the valve seat seal 42 from the valve seat 20 causes the flush cycle to be longer or shorter, thereby using more or less water as needed. Accordingly, the flush cycle may be longer if the valve actuator 100 is moved in the first direction relative to the relief valve post 40, and the flush cycle may be shorter if the valve actuator 100 is moved in the second direction relative to the relief valve post 40. In contrast, the prior design shown in FIG. 1 requires that the plunger rod 32 be displaced in a single direction. Accordingly, prior designs having a single displacement direction produce a constant, non-variable flush cycle.

Referring again to FIG. 4, the relief valve post 40 may extend through the aperture 107 of the valve actuator 100. When the valve actuator 100 is moved in a first direction through the motion of the plunger rod 32, shown generally by arrow R, the high rim 114 of the valve actuator 100 contacts and displaces the relief valve post 40 in the first direction a distance. By doing so, the valve seat seal 42 separates from the valve seat 20 by a separation distance. In one embodiment, the relief valve post 40 contacts the high rim 114 at a contact portion 40A when the valve actuator 100 is moved in the first direction, shown in FIG. 4. In another embodiment, the valve seat seal 42 separates from the valve seat 20 at separation portion 43 having an orientation that is substantially opposite from the contact portion 40A of the valve relief post 40 when the valve actuator 100 is advanced in the first direction. In another embodiment, the high rim 114 contacts the relief valve post 40 at contact portion 40A, which is disposed along the relief valve post 40 higher than that contact point which will be discussed when the valve actuator 100 travels in the opposite direction.

Referring to FIG. 5, when the valve actuator 100 is moved in a second direction through the motion of the plunger rod 32, shown generally by arrow S, the low rim 116 of the valve actuator 100 contacts and displaces the relief valve post 40 in the second direction a distance. In one embodiment, it is contemplated that the first direction and the second direction are substantially opposite, such as substantially right and left directions, substantially fore and aft directions, or substantially upwards and downwards directions. In another embodiment, it is contemplated that the first and second directions are at substantially right angles to each other, such as substantially downward and substantially aftward directions.

Figure 5A:
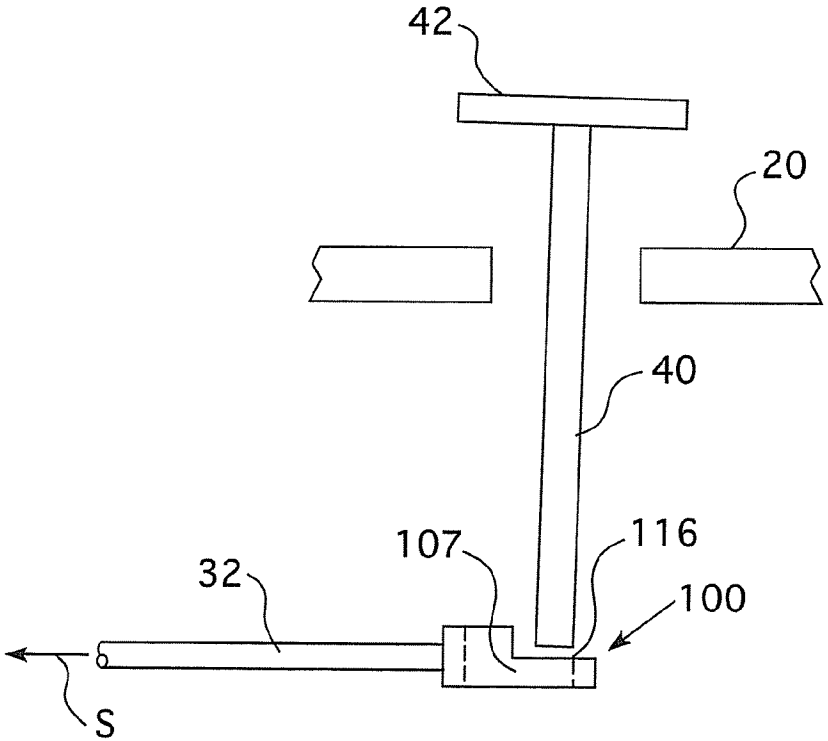
FIG. 5A is a schematic representation of the plunger rod displaced from the relief valve during a flush corresponding to the plunger rod previously oriented in the second position.
Figure 4A:
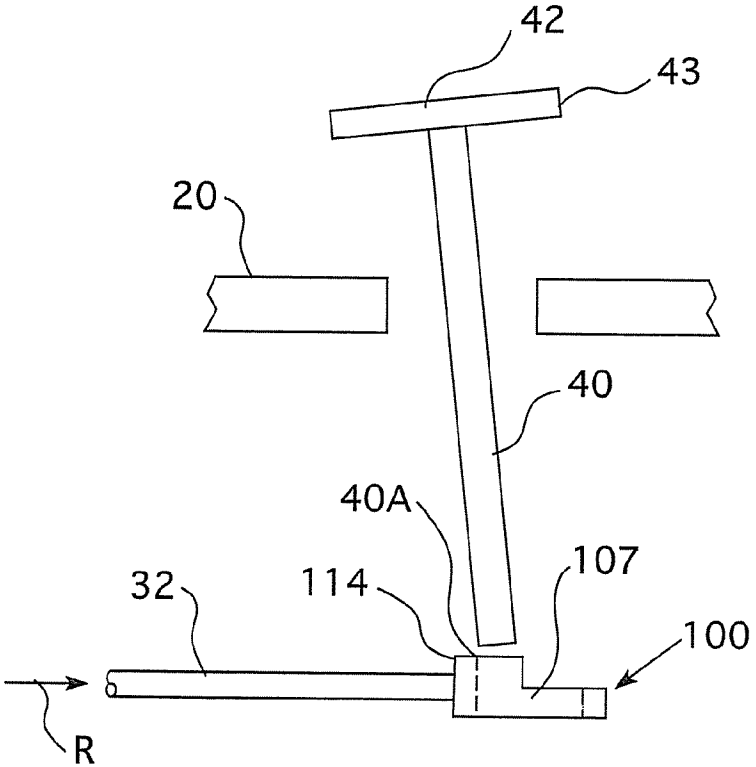
FIG. 4A is a schematic representation of the plunger rod displaced from the relief valve during a flush corresponding to the plunder rod previously oriented in the first position.

As shown in FIG. 5, when the plunger rod 32 is moved in the second direction, the valve actuator 100 contacts the relief valve post 40 at the low rim 116 and displaces the relief valve post 40 in the second direction. When the plunger rod 32 is moved a separation distance in either the first direction or the second direction, the valve seat seal 42 is separated from the valve seat 20 by an amount sufficient to provide a flush cycle. As shown in FIGS. 4A and 5A, once a flush is initiated, the relief valve post 40 disengages completely from the valve actuator 100. As shown in FIG. 4, when the valve actuator 100 is moved in a first direction, such as in direction R of FIG. 4, the valve actuator 100 contacts the valve relief post 40 at the high rim 114. In this configuration, the valve relief post 40 contacts the valve actuator 100 along distance $Z_1$ before separating entirely from the valve actuator 100 during a flush. As shown in FIG. 5, when the valve actuator 100 is moved in a second direction, such as in direction S of FIG. 5, the valve actuator 100 contacts the valve relief post 40 at the low rim 116. In this configuration, the valve relief post 40 contacts the valve actuator 100 along distance $Z_2$ before separating entirely from the valve actuator 100 during a flush. Distance $Z_1$ is greater than distance $Z_2$. Accordingly, when the valve actuator 100 is moved in the first direction, the valve relief post 40 contacts the valve actuator 100 for a greater distance than when the valve actuator 100 is moved in the second direction. When the valve actuator 100 is moved in the first direction, the valve relief post 40 contacts the valve actuator 100 for a greater distance. Due to the increased frictional resistance between the valve actuator 100 and the valve relief post 40 when the valve actuator 100 is moved in the first direction, the valve seat seal 42 is displaced from the valve seat 20 for a longer duration. This longer displacement duration corresponds to a longer flush cycle.

Accordingly, the valve actuator 100 of the present invention is adapted such that a first flush cycle is produced when the plunger rod 32 is moved in the first direction, and a second shorter flush cycle is produced when the plunger rod 32 is moved in the second direction. It is also contemplated herein that the geometry of the valve actuator 100 may be reversed such that a shorter flush cycle is produced when the plunger rod 32 is moved in the first direction, and a longer flush cycle is produced when the plunger rod 32 is moved in the second direction. It is also noted that the length of the relief valve post 40 in both FIGS. 4 and 5 is exaggerated for illustrative purposes, and that the actual design need only extend within the valve actuator aperture 107 a distance such that it may be engaged by the low rim 116.

Figure 6:
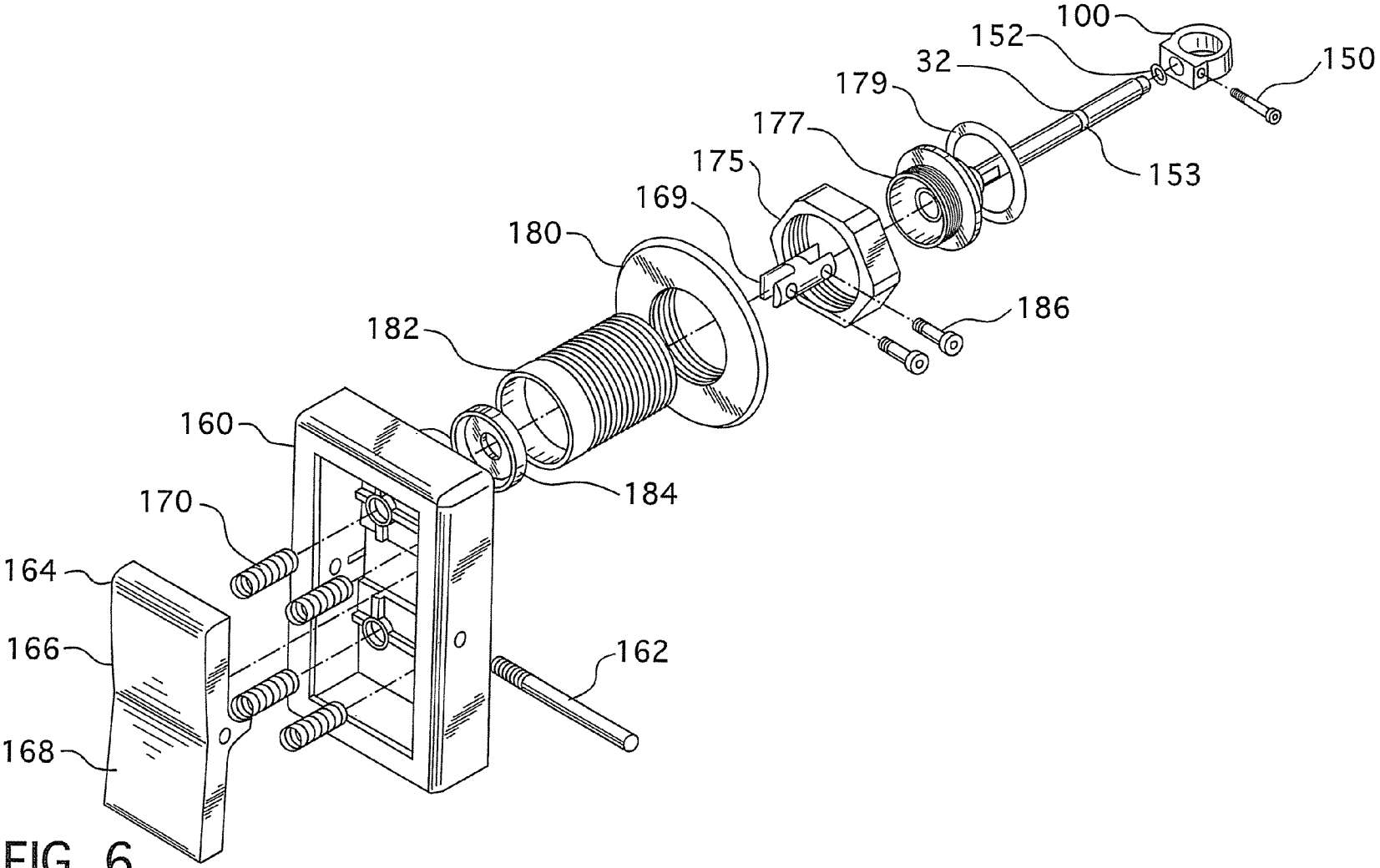
FIG. 6 is an exploded perspective view of a dual flush assembly in accordance with an embodiment of the present invention.
Figure 7:
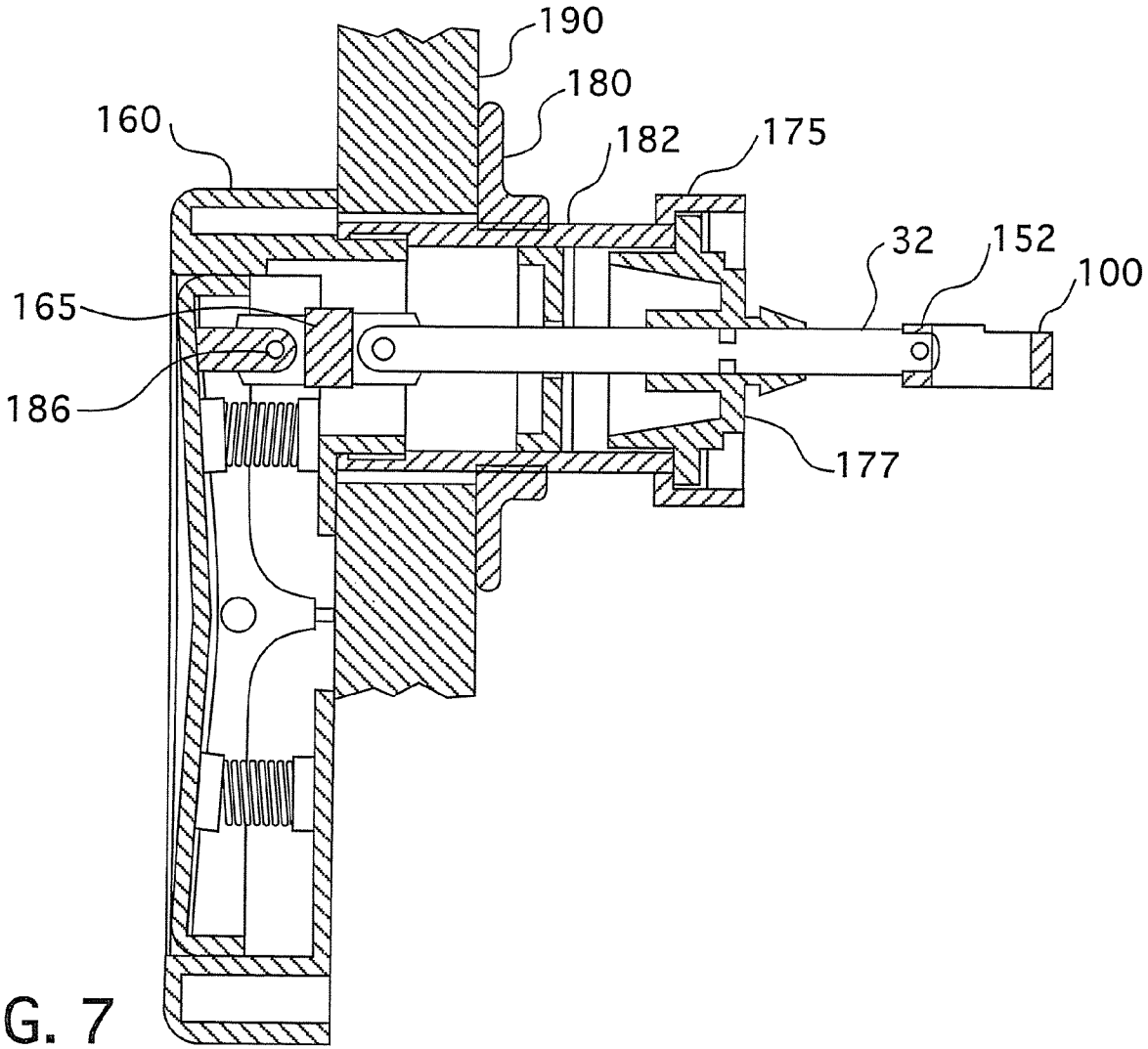
FIG. 7 is an assembled cutaway side view of the flush assembly of FIG. 6.

FIGS. 6-7 illustrate an exemplary mechanism utilized to advance the plunger rod 32 in the first or second direction. In particular, the valve actuator 100 is secured to the plunger rod 32, such as by a screw 150 or other fastening means. In one configuration, the screw 150 extends through a portion of the valve actuator 100 and engages a corresponding bore within a portion of the plunger rod 32.

Referring again to FIGS. 6-7, a switch housing 160 may have pivotally attached thereto, a pivot rod 162, and a toggle switch 164. The upper half 166 of the toggle switch 164 may be attached to the plunger rod 32 through a double-link bar 169 at attachment point 186. When the upper half 166 of the toggle switch 164 is depressed, the plunger rod 32 is moved away from the switch housing 160. When the lower half 168 of the switch housing 160 is depressed, the toggle switch 164 pivots such that the upper half 166 moves away from the switch housing 160 and the plunger rod 32 is moved toward the switch housing 160. Toggle switch springs 170 may be mounted within the switch housing 160 to retain the toggle switch 164 in a neutral position.

Referring yet again to FIGS. 6-7, an O-ring 152 may be disposed over a groove 153 within the plunger rod 32 to provide a substantially water-tight seal between the plunger rod 32 and a seal container 177. A handle nut 175 may be provided in conjunction with the seal container 177 and a handle washer 179 to provide a substantially water-tight connection between the switch housing 160 and the flush valve body 10, as shown in FIG. 1. In order to mount the switch housing 160 upon a wall, an adjusting nut 180 may be used in conjunction with a threaded sleeve 182 and a rod stabilizer 184, as is conventionally known. As shown in FIG. 7, the adjusting nut 180 may be provided in conjunction with the threaded sleeve 182 and used to urge the switch housing 160 against the wall 190 to secure the assembly. Referring again to FIG. 6, bolts 186 or other suitable fasteners may be used to secure the plunger rod 32 and the toggle switch 164 to the double-link bar 165.

Figure 9:
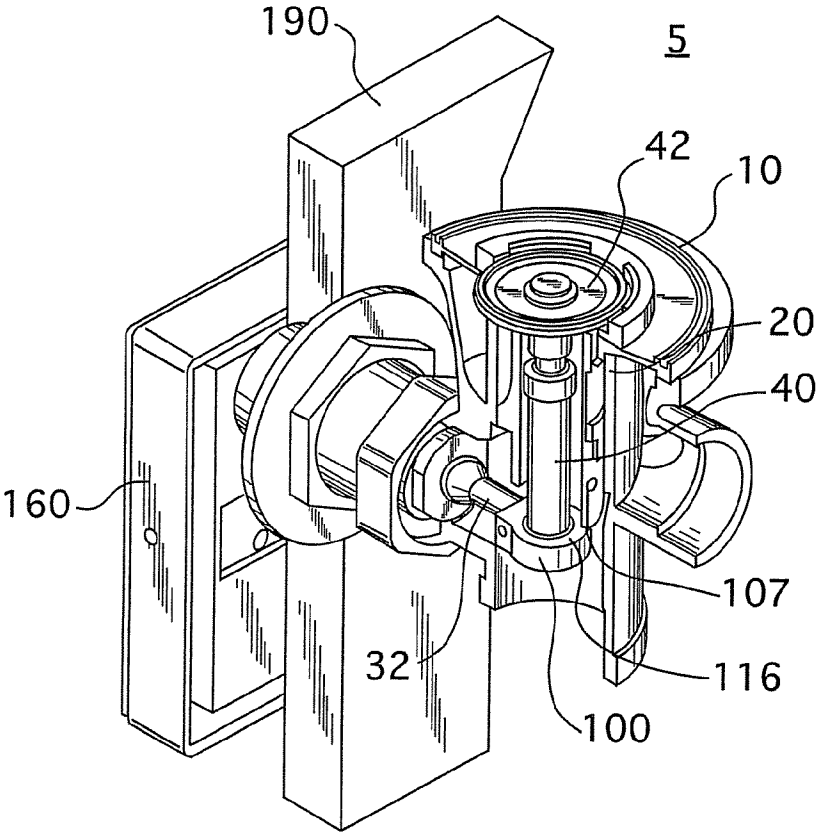
FIG. 9 is a partial cutaway right-directed perspective view of the flush assembly of FIG. 8.
Figure 8:
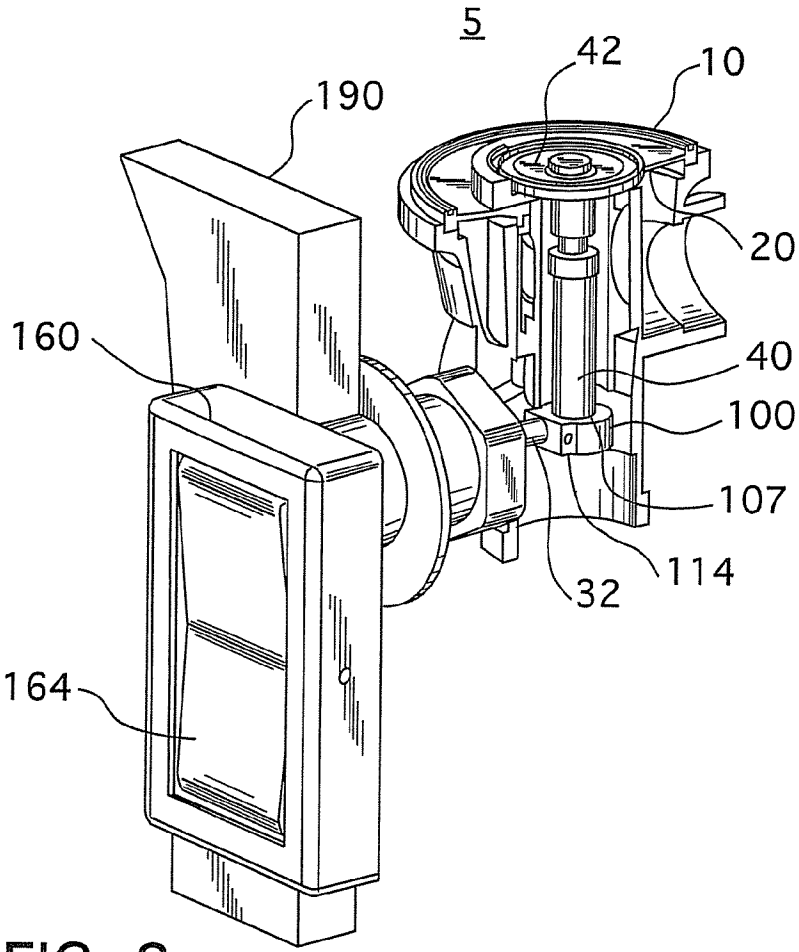
FIG. 8 is a partial cutaway left-directed perspective view of a flush assembly in accordance with an embodiment of the present invention.

As shown in FIGS. 8-9, the switch housing 160 may be engaged with the valve body 10 of a flush valve 5. Of particular interest, the aperture 107 of the valve actuator 100 surrounds at least a portion of the relief valve post 40 such that when the plunger rod 32 is moved in a first direction, the high rim 114 contacts and displaces the relief valve post 40. When the plunger rod 32 is moved in a second direction, the low rim 116 of the valve actuator 100 contacts and displaces the relief valve post 40.

Figure 10:
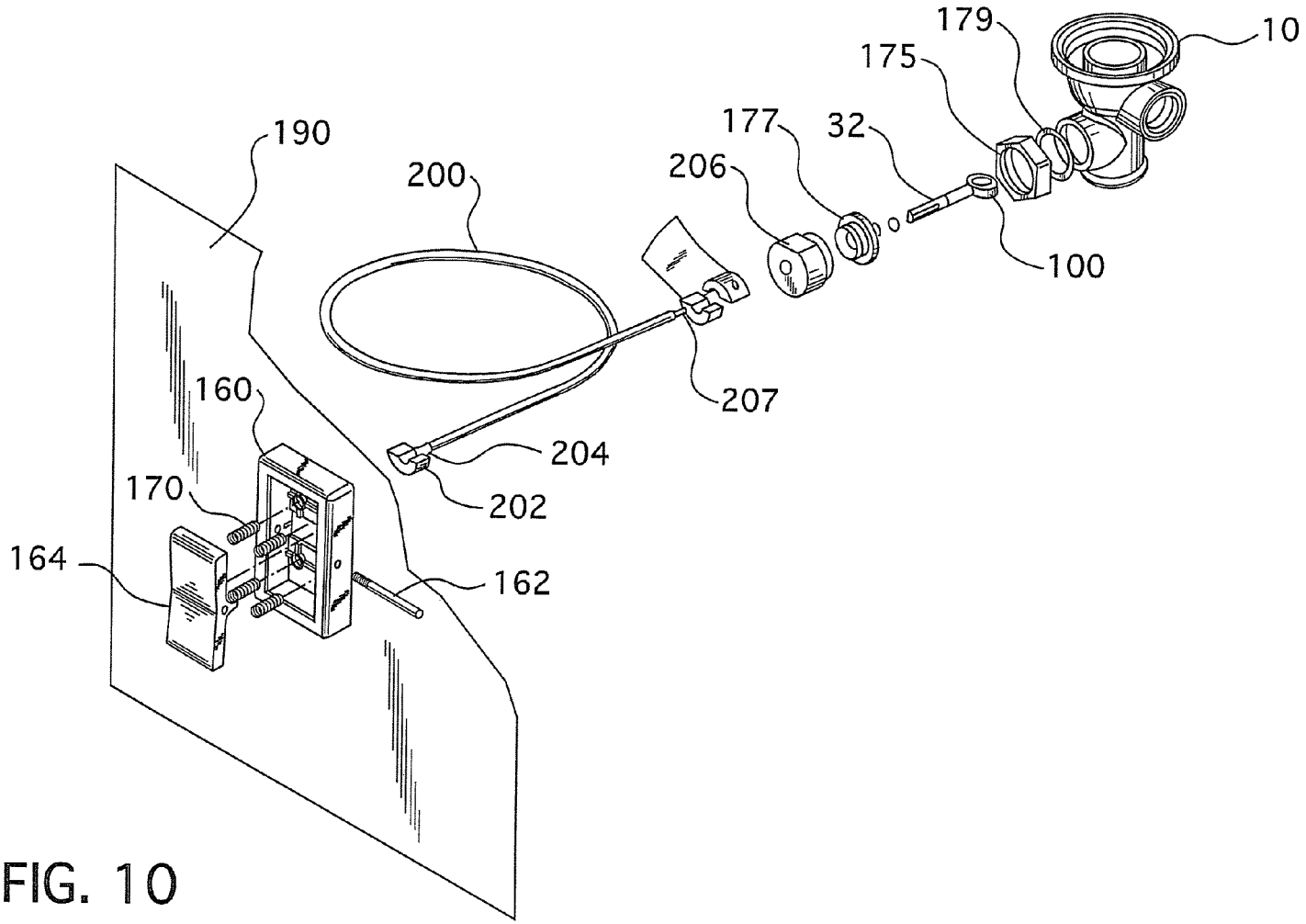
FIG. 10 is an exploded perspective view of a flush assembly in accordance with an alternative embodiment of the present invention.
Figure 11:
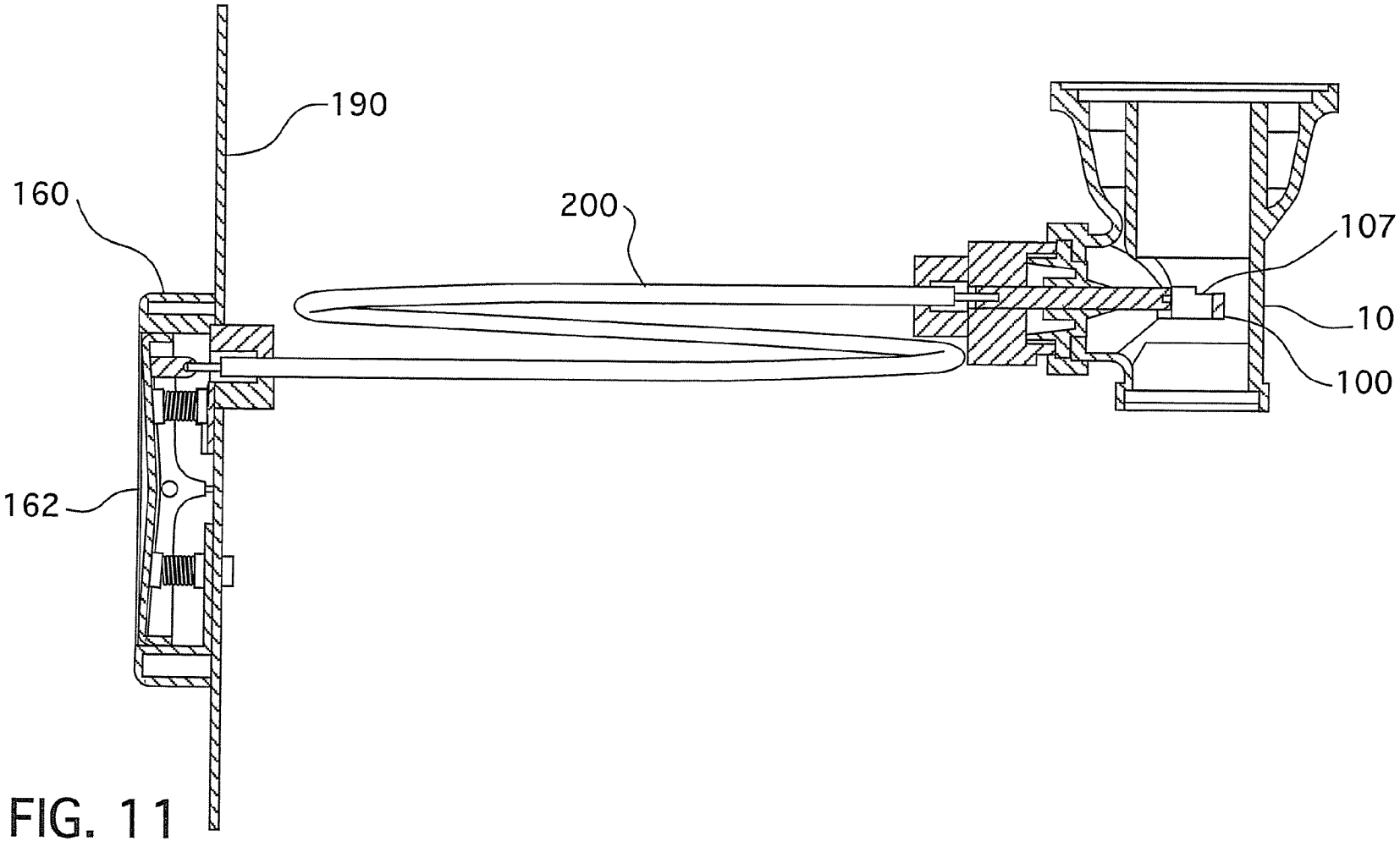
FIG. 11 is a cross-sectional side view of the assembled flush assembly of FIG. 10.

In one embodiment, the plunger rod 32 of the flush valve 5 may be aligned with the attachment point 186 of a double-link bar 169 to the toggle switch 164. In another embodiment, the attachment point 186 and the plunger rod 32 may be off-set. Under such circumstances, instead of a toggle switch 164 being mechanically connected to the plunger rod 32 via a double-link bar 169, as illustrated in FIGS. 10-11, one end 204 of a cable 200 may be connected by a clamp 202 to the toggle switch 164 and the other end 207 of the cable 200 may be attached with a second clamp 206. This may be secured to the plunger rod 32 such that by motion of the toggle switch 164, the valve actuator 100 may be moved in a first direction or in a second direction relative to the relief valve post 40 (not shown). For purposes of convenience, like parts of the remote switch housing assembly have common reference numbers to the embodiment discussed with respect to FIGS. 6-7. However, FIGS. 10-11 further illustrates the manner by which the switch housing assembly may be secured to the valve body 10.

The switch housing assembly discussed herein may be utilized as a retrofit unit for a water closet with a concealed valve. It allows for water conservation by giving the user a choice between a full flush, such as about 1.6 gallons, and a reduced flush, such as about 0.8 gallons. In particular, a full flush is available when the high rim 114 of the valve actuator 100 is displaced against the relief valve post 40 by the plunger rod 32, while a reduced flush is available when the low rim 116 of the valve actuator 100 is moved by the plunger rod 32 against the relief valve post 40. This permits the least amount of water to be used to evacuate the toilet bowl.

An additional benefit of the design discussed herein is that it allows for a quick and easy retrofit to a new or currently installed flush valve. With reference to FIG. 1, the flush actuator assembly 30 may be easily removed by removing the handle nut 175 and the switch housing assembly may then be inserted within the valve body 10 such that the valve actuator 100 engages the relief valve post 40. The handle nut 175 may then be again secured to the valve body 10 and the system is again operable but with a full flush and a reduced flush now available. The unit is also designed to allow for different distances between the wall, where the toggle switch is placed, and the flush valve, which is concealed behind the wall. The water pressure available at the flush valve does not affect the ability to retrofit existing flush valves with this switch housing assembly. Communication between the actuator 100 and the toggle switch 164 may be provided through either a direct linkage bar or via a mechanical cable. In either instance, when the user pushes either side of the toggle switch, the flush actuator activates the internal relief valve on the flush valve.

Referring to FIGS. 12-17, in an alternative embodiment of the present invention, a flush valve 105 includes a body 110 having an inlet 112 and an outlet 214, as previously described. The inlet is generally connected to a water supply and the outlet is connected to a toilet or urinal. A valve 216 having a valve seat and a valve seat seal as previously described herein is also included.

Figure 12:
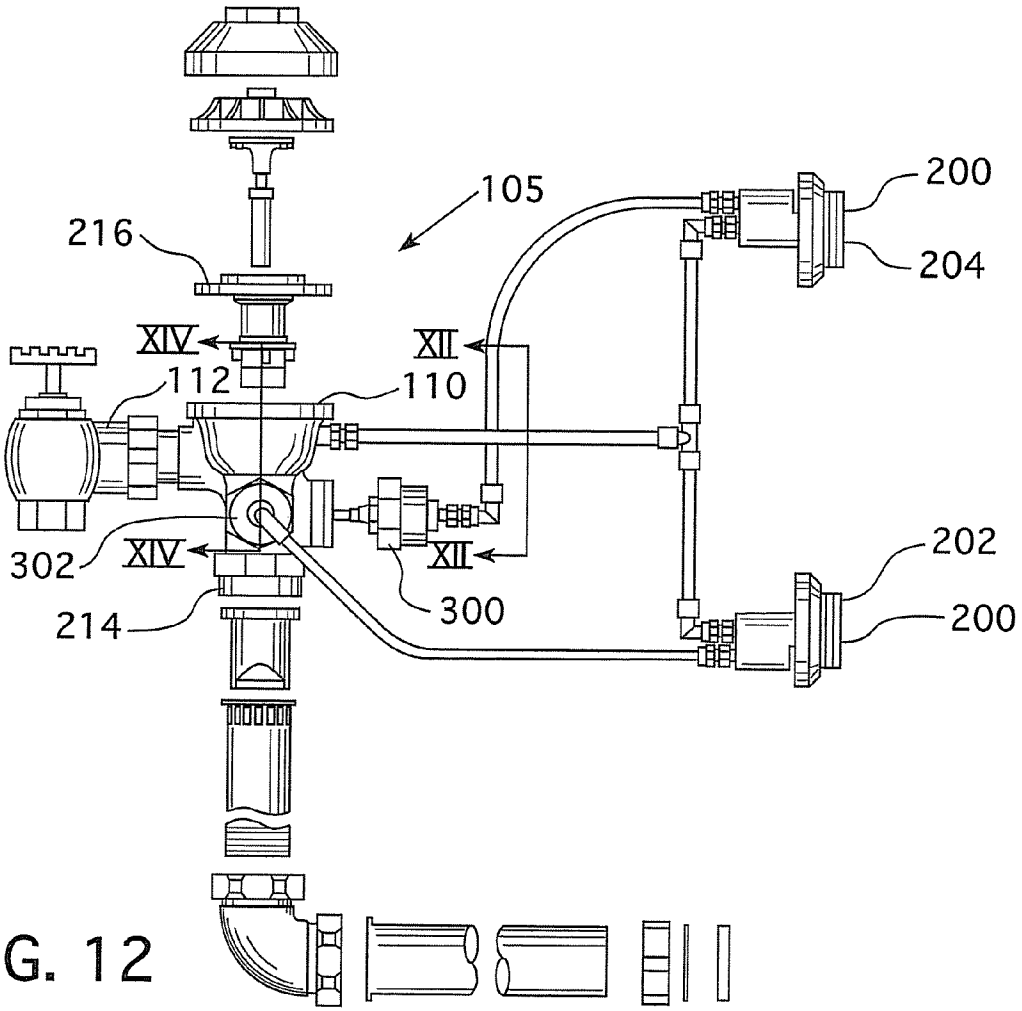
FIG. 12 is an exploded view of a flush assembly having a full-flush push button and a reduced-flush push button in accordance with an alternative embodiment of the present invention.
Figure 14:
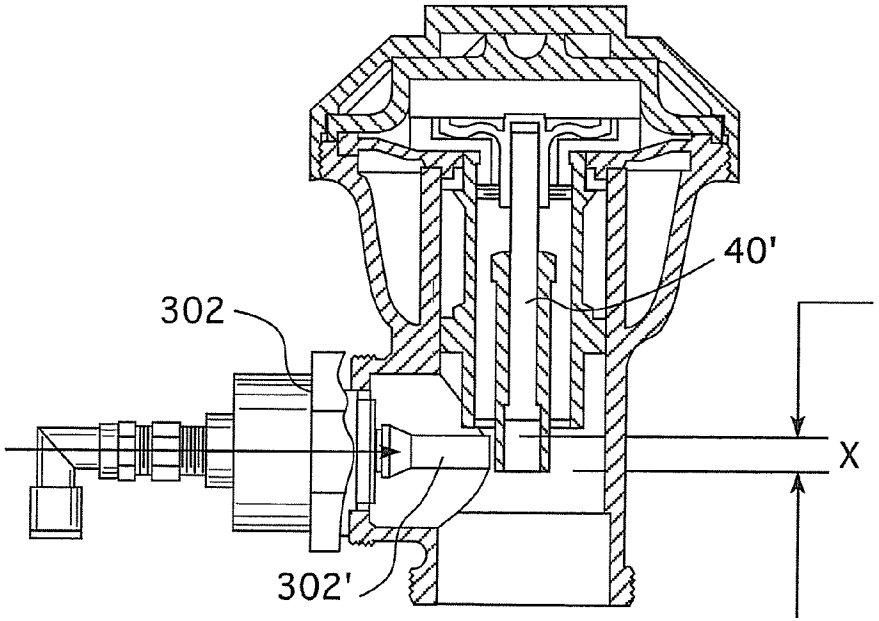
FIG. 14 is a cross-sectional view of the flush assembly of FIG. 12 taken along line XIV-XIV.
Figure 13:
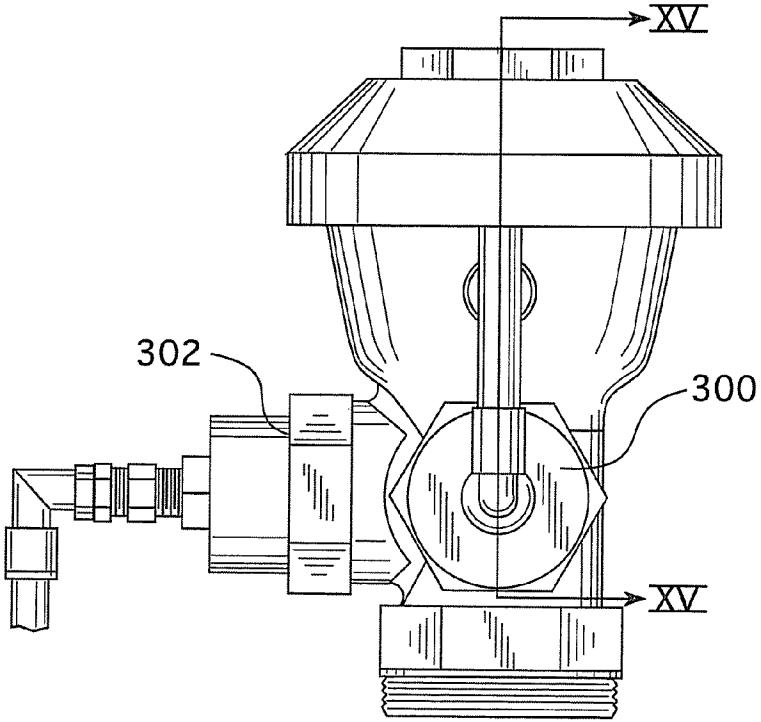
FIG. 13 is a front view of the flush assembly of FIG. 12 taken along line XIII-XIII.
Figure 16:
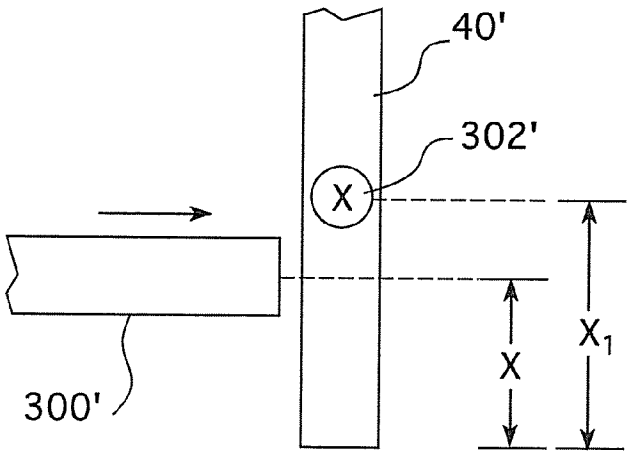
FIG. 16 is a section of an elevational view of the valve actuator rods and relief valve post of the flush assembly of FIG. 12.
Figure 15:
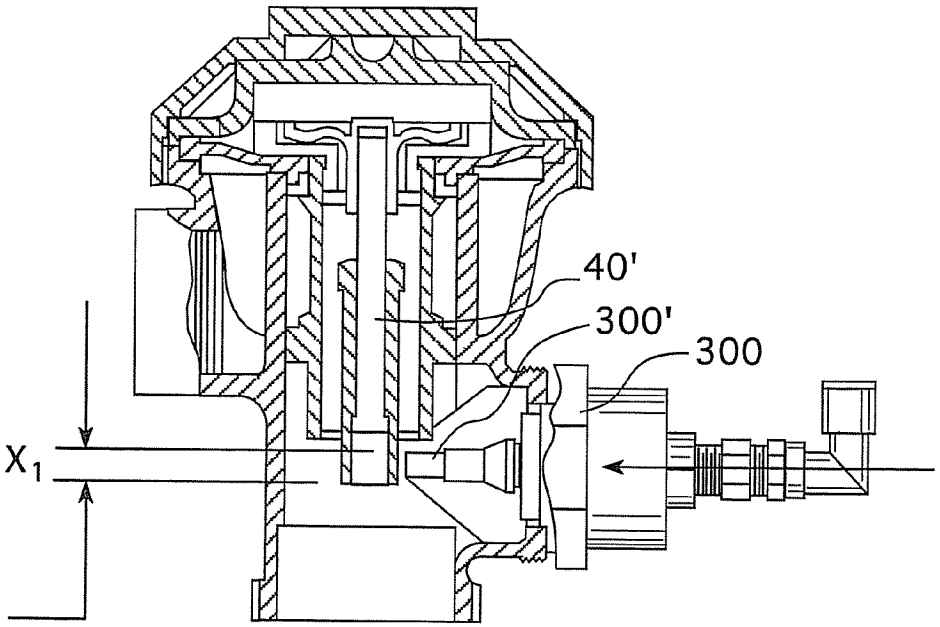
FIG. 15 is a cross-sectional view of the flush assembly of FIG. 12 taken along line XV-XV of FIG. 14.

The embodiment shown in FIGS. 12-17, includes a plurality of valve actuators 300 and 302 positioned about the relief valve post 40'. In this embodiment, the valve actuators 300 and 302 include valve actuator rods 300' and 302', respectively, for contacting the relief valve post 40' when pressurized fluid, such as pressurized water, is directed through the valve actuators 300 and 302. As shown in FIG. 12, valve actuator 300 is provided in fluid communication with an initiating mechanism 200 which, when deployed, forces pressurized fluid through the valve actuator 300 to advance the actuator rod 300' (shown in FIGS. 15-17) to contact the relief valve post 40'. Actuator rod 300' of valve actuator 300 contacts the relief valve post 40' at a first location X, shown in FIGS. 15-16. Similarly, valve actuator 302 is provided in fluid communication with an initiating mechanism 200 which, when deployed, forces pressurized fluid through the valve actuator 302 to advance the actuator rod 302' (shown in FIGS. 14, and 16-17) to contact the relief valve post 40'. Actuator rod 302' of valve actuator 302 contacts the relief valve post 40' at a second location $X_1$, shown in FIGS. 15-16. Actuator rods 300 and 302 are adapted to contact the relief valve post 40 at different axial positions. With reference to FIGS. 4-5, contacting the relief valve post 40 at different locations along the relief valve post 40; results in either a full flush or a reduced flush, depending on the separation distance between the valve seat and the valve seat seal. In the embodiment shown in FIGS. 12-17, actuator rods 300' and 302' contact with the relief valve post 40 at different axial locations to achieve either a full flush or a reduced flush, as similarly described above with reference to FIGS. 4-5.

As shown in FIG. 12, two actuators 300 and 302 may be positioned about the relief valve post 40'. In one embodiment, as shown clearly in FIG. 17, the valve actuators are offset with respect to each other by about 90°. With reference again to FIG. 12, valve actuator 300 may be coupled to a first initiating mechanism, such as push button 204 and valve actuator 302 may be coupled to a second initiating mechanism, such as push button 202. In this configuration, a user may select whether to initiate a full flush or a reduced flush by selecting between push button 202 and push button 204. Once a user deploys one of push button 202 and push button 204, either valve actuator 300 or 302 is activated. Once activated, the selected valve actuator 300 or 302 forces pressurized liquid to move the corresponding valve actuator rod 300' or 302' to contact the relief valve post 40 at a predetermined axial location which corresponds to either a full flush or a reduced flush. In another embodiment, the valve actuators may be coupled to each other, such as hydraulically coupled to each other.

Figure 17A:
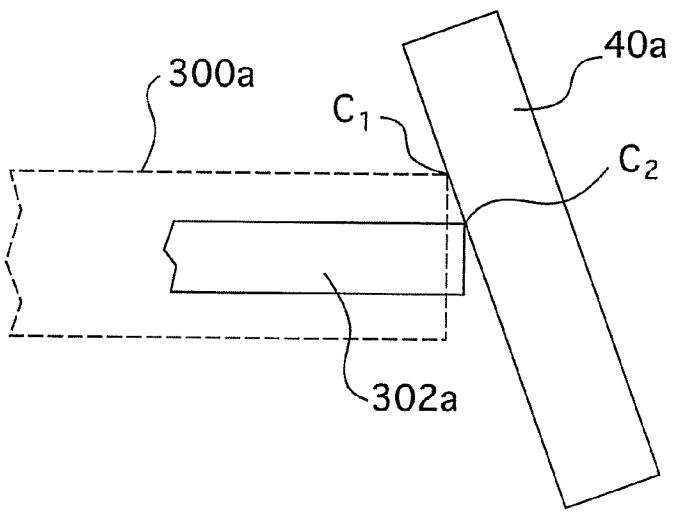
FIG. 17A is a schematic representation of the height difference along the relief valve post at which the first actuator rod and the second actuator rod of FIG. 17 make contact therewith.
Figure 17:
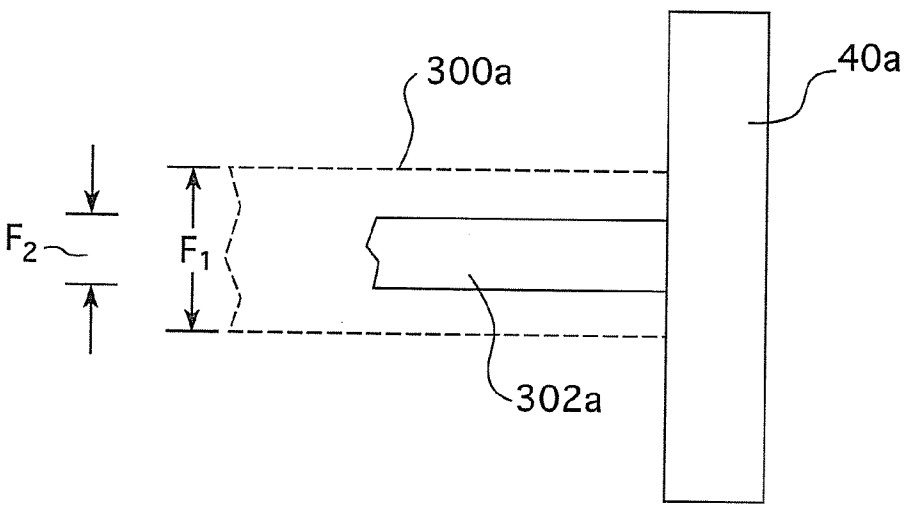
FIG. 17 is a schematic representation of a first actuator rod and a second actuator rod having a larger diameter contacting the relief valve post of a flush assembly in accordance with an embodiment of the present invention.

In a further embodiment, as shown in FIGS. 17 and 17A, two actuators 300*a* and 302*a* may be positioned about the relief valve post 40*a*. The first actuator 300*a* may have a larger contact diameter $F_1$ than the contact diameter $F_2$ of the second actuator 302*a*. As shown in FIG. 17A, the first actuator 300*a* will contact the valve relief post 40*a* at a first contact location $C_1$, and the second actuator 302*a* will contact the relief valve post 40*a* at a second contact location $C_2$. The first contact location $C_1$ is higher than the second contact location $C_2$, corresponding to difference between a full flush cycle and a partial flush cycle, respectively. It is anticipated herein that the first actuator 300*a* and the second actuator 302*a* may be employed within any of the embodiments herein described.

Referring once again to FIG. 12, supply line A provides fluid, such as water, from the inlet 112 of the body 110 to supply lines B and C. Supply lines B and C are connected to the first push button 200 and the second push button 202 respectively to provide water thereto. The first push button 200 includes a check valve D, and the second push button 202 includes a check valve E, such that when the initiating mechanism 200 is pushed, the relief valve post 40 is contacted by valve actuator rod 300' or 302' respectively causing a flush. Once the flush occurs, the actuator rod 300' or 302' returns to the original un-activated position.

As is evident, the present invention utilizes either a plurality of actuator rods to contact the valve post at different locations to select different flow rates, or utilizes a single actuator rod contacting the valve post at different locations. Preferably, the contact points are axially and circumferentially spaced from each other.

A user may select to deploy the first push button 200, activating valve actuator 300, if solid waste is present within a toilet. Alternatively, the user may select to deploy the second push button 202, activating valve actuator 302, if only liquid waste is present within a toilet. Accordingly, a user may move valve actuator rod 300' or valve actuator 300 in an axial direction to initiate a full flush cycle, or may move valve actuator rod 302' of valve actuator 302 in an axial direction to initiate a reduced flush cycle. It is further contemplated herein that at least one sensor (not shown) may be utilized to sense the presence of solid waste within the toilet and may select between the full flush and the reduced flush based on the presence of waste within the toilet, or lack thereof.

While specific embodiments of the invention have been described in detail, it will be appreciated by those skilled in the art that various modifications and alternatives to those details could be developed in light of the overall teachings of the disclosure. The presently preferred embodiments described herein are meant to be illustrative only and not limiting as to the scope of the invention which is to be given the full breadth of the appended claims and any and all equivalents thereof.

The invention claimed is:

1. A flush actuator assembly, for use with a flush valve having a relief valve post, comprising:

a valve actuator having a first end, a second end, and an aperture extending therebetween, the aperture adapted to surround at least a portion of the relief valve post such that movement of the valve actuator in a first direction engages the relief valve post at a first location on the post and displaces the relief valve post by a first separation distance, and movement of the valve actuator in a second direction engages the relief valve post at a second location on the post and displaces the relief valve post by a second separation distance, wherein the first separation distance and the second separation distance are different;

wherein the first end of the valve actuator comprises a high rim and a low rim; and wherein the high rim extends in an opposite direction from the second end by a first length, and the low rim extends in an opposite direction from the second end by a second length, the first length being greater than the second length.

2. The flush actuator assembly of claim 1, further comprising a plunger rod connected to the valve actuator such that movement of the plunger rod moves the valve actuator in at least one of the first direction and second direction.

3. The flush actuator assembly of claim 2, further comprising a housing having a bore extending therethrough, wherein the plunger rod extends at least partially through the bore.

4. The flush actuator assembly of claim 1, further comprising an initiating mechanism for transitioning the valve actuator in at least one of a first direction and a second direction.

5. The flush actuator assembly of claim 4, wherein the initiating mechanism is at least one of a push button and a sensor.

6. The flush actuator assembly of claim 1, wherein movement of the valve actuator in the first direction contacts the relief valve post with the high rim, and movement of the valve actuator in the second direction contacts the relief valve post with the low rim.

7. The flush actuator assembly of claim 1, wherein the first direction and the second direction are substantially opposite from each other.

8. The flush actuator assembly of claim 1, wherein the first direction and the second direction are at substantially right angles with respect to each other.

9. The flush actuator assembly of claim 1, wherein movement of the valve actuator in the first direction initiates a full flush cycle, and movement of the valve actuator in the second direction initiates a reduced flush cycle.

10. A flush valve, comprising:

a housing having an inlet and an outlet;

a valve seat disposed between the inlet and the outlet;

a valve seat seal engageable with the valve seat to form a substantially liquid impermeable seal therewith;

a relief valve post engaged with the valve seat seal;

a valve actuator having a first end, a second end, and an aperture extending therebetween, the aperture adapted to surround at least a portion of the relief valve post such that movement of the valve actuator in a first direction engages the relief valve post at a first location on the post and displaces the relief valve post by a first separation distance which disengages the valve seat seal from the valve seat, and movement of the valve actuator in a second direction engages the relief valve post at a second location on the post and displaces the relief valve post by a second separation distance which disengages the valve seat seal from the valve seat, wherein the first separation distance and the second separation distance are different;

wherein the first end of the valve actuator comprises a high rim and a low rim; and wherein the high rim extends in an opposite direction from the second end by a first length, and the low rim extends in an opposite direction from the second end by a second length, the first length being greater than the second length.

11. The flush valve of claim 10, further comprising a plunger rod connected to the valve actuator such that movement of the plunger rod moves the valve actuator in at least one of the first direction and second direction.

12. The flush valve of claim 10, further comprising an initiating mechanism for transitioning the valve actuator in at least one of a first direction and a second direction.

13. The flush valve of claim 12, wherein the initiating mechanism is at least one of a push button and a sensor.

14. The flush valve of claim 10, wherein the first end of the valve actuator comprises a high rim and a low rim, and wherein movement of the valve actuator in the first direction contacts the relief valve post with the high rim, and movement of the valve actuator in the second direction contacts the relief valve post with the low rim.

15. The flush valve of claim 1, wherein movement of the valve actuator in the first direction initiates a full flush cycle, and movement of the valve actuator in the second direction initiates a reduced flush cycle.

16. A method of actuating a flush valve to select a flush cycle comprising the steps of:

providing a flush valve, comprising:

a housing having an inlet and an outlet;

a valve seat disposed between the inlet and the outlet;

a valve seat seal engageable with the valve seat to form a substantially liquid impermeable seal therewith;

a relief valve post engaged with the valve seat seal; and a valve actuator having a first end, a second end, and an aperture extending therebetween, the aperture adapted to surround at least a portion of the relief valve post such that movement of the valve actuator in a first direction engages the relief valve post at a first location on the post and displaces the relief valve post by a first separation distance which disengages the valve seat seal from the valve seat, and movement of the valve actuator in a second direction engages the relief valve post at a second location on the post and displaces the relief valve post by a second separation distance which disengages the valve seat seal from the valve seat, wherein the first separation distance and the second separation distance are different;

wherein the first end of the valve actuator comprises a high rim and a low rim; and wherein the high rim extends in an opposite direction from the second end by a first length, and the low rim extends in an opposite direction from the second end by a second length, the first length being greater than the second length;

moving the valve actuator in either a first direction to initiate a full flush cycle, or a second direction to initiate a reduced flush cycle.

17. The method of actuating a flush valve of claim 16, wherein the step of moving the valve actuator further comprises initiating at least one of a plunger rod, push button and a sensor to move the valve actuator in either the first direction or the second direction.

18. A flush actuator assembly, for use with a flush valve having a relief valve post, comprising:

a plurality of valve actuators positioned at different radial locations about the relief valve post such that movement of one of the valve actuators in an axial direction contacts the relief valve post at a first location on the post and displaces the relief valve post by a first separation distance, and movement of another of the valve actuators in an axial direction contacts the relief valve post at a second location on the post and displaces the relief valve post by a second separation distance, wherein the first separation distance and the second separation distance are different; and wherein a first valve actuator has a contact diameter that is greater than a contact diameter of a second valve actuator.

19. The flush actuator assembly of claim 18, wherein the assembly comprises two valve actuators.

20. The flush actuator assembly of claim 19, wherein the valve actuators are positioned at radial locations offset by about 90° from one another.

21. The flush actuator assembly of claim 18, wherein each of the valve actuators comprise a rod adapted to contact the relief valve post.

22. The flush actuator assembly of claim 18, wherein each of the valve actuators contact the relief valve post by activation of an initiating mechanism.

23. The flush actuator assembly of claim 22, wherein the initiating mechanism is a push button.

24. The flush actuator assembly of claim 18, wherein each of the valve actuators are coupled to each other.

25. The flush actuator assembly of claim 18, wherein each of the valve actuators are hydraulically coupled to each other.

26. A flush valve, comprising:

a housing having an inlet and an outlet;

a valve seat disposed between the inlet and the outlet;

a valve seat seal engageable with the valve seat to form a substantially liquid impermeable seal therewith;

a relief valve post engaged with the valve seat seal;

a plurality of valve actuators positioned about the relief valve post such that movement of one of the valve actuators in an axial direction contacts the relief valve post at a first location on the post and displaces the relief valve post by a first separation distance, and movement of another of the valve actuators in an axial direction contacts the relief valve post at a second location on the post and displaces the relief valve post by a second separation distance, wherein the first separation distance and the second separation distance are different; and wherein a first valve actuator has a contact diameter that is greater than a contact diameter of a second valve actuator.

27. The flush valve of claim 26, wherein the housing includes a plurality of actuator passageways to receive a respective valve actuator therein.

28. The flush valve of claim 26, wherein the valve includes two valve actuators offset to each other by 90°, and the housing includes two actuator passageways to receive the respective valve actuators therein.

29. A method of actuating a flush valve to select a flush cycle comprising the steps of:

providing a flush valve comprising:

a housing having an inlet and an outlet;

a valve seat disposed between the inlet and the outlet;

a valve seat seal engageable with the valve seat to form a substantially liquid impermeable seal therewith;

a relief valve post engaged with the valve seat seal; and a plurality of valve actuators positioned about the relief valve post such that movement of one of the valve actuators in an axial direction contacts the relief valve post at a first location on the post and displaces the relief valve post by a first separation distance, and movement of another of the valve actuators in an axial direction contacts the relief valve post at a second location on the post and displaces the relief valve post by a second separation distance, wherein the first separation distance and the second separation distance are different; and wherein a first valve actuator has a contact diameter that is greater than a contact diameter of a second valve actuator;

moving one valve actuator in an axial direction to initiate the full flush cycle, or moving another valve actuator in an axial direction to initiate a reduced flush cycle.

30. A flush valve, comprising:

a housing having an inlet and an outlet;

a valve seat disposed between the inlet and the outlet;

a seal engageable with the valve seat to form a substantially liquid impermeable seal therewith, wherein the seal has a seal central opening extending therethrough;

a relief valve post having a valve seat seal engaged with the seal central opening;

first and second valve actuator rods positioned at different radial locations about the relief valve post such that: linear movement of the first valve actuator rod in an axial direction of the first actuator rod causes the first actuator rod to contact the relief valve post at a first location on the post and displaces the valve seat seal by a first separation distance from the seal central opening, and movement of the second valve actuator rod in an axial direction of the second actuator rods causes the second actuator rod to contact the relief valve post at a second location on the post and displaces the valve seat seal by a second separation distance from the seal central opening, wherein the first separation distance and the second separation distance are different; and wherein the first valve actuator rod has a contact diameter that is greater than a contact diameter of the second valve actuator rod.

31. The flush valve of claim 30, wherein the housing includes a plurality of actuator passageways to receive a respective valve actuator therein.

32. The flush valve of claim 30, wherein the first and second valve actuator rods are offset to each other by 90° about the relief valve post.

33. A method of actuating a flush valve to select a flush cycle comprising the steps of:

providing a flush valve comprising:

a housing having an inlet and an outlet;

a valve seat disposed between the inlet and the outlet;

a seal engageable with the valve seat to form a substantially liquid impermeable seal therewith, wherein the seal has a seal central opening extending therethrough; and a relief valve post having a valve seat seal engaged with the seal central opening;

positioning first and second valve actuators at spaced apart locations about the relief valve post and at different radial locations about the relief valve post, wherein the first valve actuator is operable to linearly move to an extent to contact the relief valve post at a first location on the post and cause displacement of the valve seal seat by a first separation distance from the seal central opening to provide a full flush cycle;

and the second valve actuator is operable to linearly move to an extent to contact the relief valve post at a second location on the post and cause displacement of the valve seal seat by a second separation distance from the seal central opening to provide a reduced flush cycle, wherein the first separation distance and the second separation distance are different; and wherein a first valve actuator has a contact diameter that is greater than a contact diameter of a second valve actuator;

selectively operating the first valve actuator to initiate the full flush cycle or the second valve actuator to initiate the reduced flush cycle.

34. The method according to claim 33, comprising providing the first actuator as a rod of a first diameter and providing the second actuator as a rod of second diameter wherein the first and second diameters are different.

35. A flush actuator assembly, for use with a flush valve having a relief valve post, comprising:

a plurality of valve actuators positioned about the relief valve post such that movement of one of the valve actuators in an axial direction contacts the relief valve post at a first location on the post and displaces the relief valve post by a first separation distance, and movement of another of the valve actuators in an axial direction contacts the relief valve post at a second location on the post and displaces the relief valve post by a second separation distance, wherein the first separation distance and the second separation distance are different, wherein a first valve actuator has a contact diameter that is greater than a contact diameter of a second valve actuator.

* * * * *